US011326431B2

(12) United States Patent
Ben-Zvi et al.

(10) Patent No.: US 11,326,431 B2
(45) Date of Patent: May 10, 2022

(54) DENSE AQUEOUS GRAVITY DISPLACEMENT OF HEAVY OIL

(71) Applicant: CENOVUS ENERGY INC., Calgary (CA)

(72) Inventors: Amos Ben-Zvi, Calgary (CA); Ishan Deep S. Kochhar, Calgary (CA); Michael Patrick McKay, Calgary (CA)

(73) Assignee: Cenovus Energy Inc., Calgary (CA)

( * ) Notice: Subject to any disclaimer, the term of this patent is extended or adjusted under 35 U.S.C. 154(b) by 56 days.

(21) Appl. No.: 16/779,384

(22) Filed: Jan. 31, 2020

(65) Prior Publication Data

US 2020/0248542 A1 Aug. 6, 2020

Related U.S. Application Data

(60) Provisional application No. 62/800,305, filed on Feb. 1, 2019.

(51) Int. Cl.

| | |
|---|---|
| ***E21B 43/24*** | (2006.01) |
| ***E21B 43/30*** | (2006.01) |
| ***E21B 43/40*** | (2006.01) |

(52) U.S. Cl.

CPC ..... *E21B 43/24* (2013.01); *E21B 43/305* (2013.01); *E21B 43/40* (2013.01)

(58) Field of Classification Search

CPC ..... E21B 25/08; E21B 36/001; E21B 49/06; E21B 49/081; E21B 43/2406; E21B 43/2408; E21B 47/06; E21B 43/24; E21B 43/305; E21B 43/40

See application file for complete search history.

(56) References Cited

U.S. PATENT DOCUMENTS

| | | | |
|---|---|---|---|
| 4,495,995 | A | 1/1985 | Chen |
| 4,706,752 | A | 11/1987 | Holm |
| 5,017,288 | A | 5/1991 | Thew et al. |

(Continued)

FOREIGN PATENT DOCUMENTS

| | | |
|---|---|---|
| CA | 1130201 | 8/1982 |
| CA | 2015459 | 10/1991 |

(Continued)

OTHER PUBLICATIONS

Bhatnagar, M. & Sverdrup, C. J., Advances in Compact Flotation Units (CFUs) for Produced Water Treatment, Offshore Technology Conference Asia held in Kuala Lumpur, Malaysia, Mar. 25-28, 2014 (OTC-24679-MS).

(Continued)

*Primary Examiner* — Zakiya W Bates

(74) *Attorney, Agent, or Firm* — Gordon & Jacobson, P.C.

(57) ABSTRACT

Methods are provided that facilitate the production of hydrocarbons from subterranean formations, involving the mobilization of an immobile heavy oil in situ by gravity displacement. In effect, heavy oil is mobilized by dense aqueous gravity displacement (DAGD), in a process that generally involves injecting a dense, heated aqueous injection fluid into the formation into an injection zone that is in fluid communication with immobile heavy oil. The injection well is operated so that the injection fluid mobilizes and displaces the immobile heavy oil, to produce an expanding upper zone of mobilized heavy oil amenable to production.

16 Claims, 9 Drawing Sheets

(56) References Cited

U.S. PATENT DOCUMENTS

| | | | | |
|---|---|---|---|---|
| 5,071,557 | A | 12/1991 | Schubert | |
| 5,435,393 | A | 7/1995 | Brekke et al. | |
| 5,437,793 | A | 8/1995 | Alper | |
| 5,667,686 | A | 9/1997 | Schubert | |
| 5,698,139 | A | 12/1997 | Alper | |
| 5,803,179 | A | 9/1998 | Echols | |
| 5,837,146 | A | 11/1998 | Alper | |
| 5,961,823 | A | 10/1999 | Alper | |
| 6,112,815 | A | 9/2000 | Slashed | |
| 6,112,817 | A | 9/2000 | Voll | |
| 6,180,010 | B1 | 1/2001 | Alper | |
| 7,264,722 | B2 | 9/2007 | Alper | |
| 7,409,999 | B2 | 8/2008 | Henriksen | |
| 2015/0158196 | A1* | 6/2015 | Hayden | B24C 1/045 405/43 |
| 2016/0244346 | A1* | 8/2016 | Bernar | C02F 1/02 |
| 2016/0245071 | A1* | 8/2016 | Vincelette | E21B 47/135 |

FOREIGN PATENT DOCUMENTS

| | | |
|---|---|---|
| CA | 2015460 | 10/1991 |
| CA | 2641294 | 4/2010 |
| CA | 2729430 | 7/2011 |
| CA | 2761321 | 8/2012 |
| CA | 2830741 | 4/2015 |
| CA | 3008545 | 12/2018 |

OTHER PUBLICATIONS

Feng et al. 2010, J Petrol Sci Eng 75:13-18.

Jamaloei and Singh, 2016, Energy Sources, Part A: Recovery, Utilization, and Environmental Effects, 38:14, 2009-2017.

Law, D. H. S., Nasr, T. N., & Good, W. K. (Aug. 1, 2003). Field-Scale Numerical Simulation of SAGD Process With Top-Water Thief Zone. Petroleum Society of Canada, doi:10.2118/03-08-01.

Li et al. 2016, Petrol Explor Prod Technol 6: 63.

Luo et al. 1999, Petrol Geology Oilfield Development in Daqing 18(5):39-41.

Edmunds and Chhina, Economic Optimum Operating Pressure for SAGD Projects in Alberta, Journal of Canadian Petroleum Technology Distinguished Authors Series, Dec. 2001, vol. 40, No. 12.

M. Collins, The False Lucre of LPSAGD, Journal of Canadian Petroleum Technology, Jan. 2007, vol. 46, No. 1 , p. 20-27.

SAGD in Oil Sands Reservoirs with no caprock and top water zone by A. Alturki, I.D. Gates and B. Maini, (2011).

* cited by examiner

DENSE AQUEOUS GRAVITY DISPLACEMENT OF HEAVY OIL

FIELD OF THE INVENTION

Process are disclosed in the field of hydrocarbon reservoir engineering, particularly recovery processes that make use of dense aqueous fluids to heat, mobilize and displace a heavy oil in situ.

BACKGROUND OF THE INVENTION

Viscous hydrocarbons in some subterranean deposits can be extracted in situ by physical displacement and/or lowering the viscosity of the hydrocarbons, so as to mobilize the hydrocarbons for recovery from a production well. Reservoirs of such deposits are extensive, and are variously referred to as reservoirs of heavy oil, bitumen, oil sands, or (previously) tar sands.

Techniques for physical displacement of heavy oils include immiscible displacement, for example by gas or water injection (Jamaloei and Singh, 2016, Energy Sources, Part A: Recovery, Utilization, and Environmental Effects, 38:14, 2009-2017). In displacement techniques, the viscosity and hence relative mobility of the displacing and displaced fluids is reflected in a mobility ratio. In conventional water flooding, for example, if the mobility ratio is then under the imposed pressure differential the in situ oil will be capable of travelling with a velocity equal to or greater than that of the injected water, and the water will push the oil in what may be called "piston-like displacement". In contrast, if the mobility ratio is , then there will be a tendency for the oil to be by-passed, resulting in conditions under which the volume of injected water required to produce movable oil will typically be many multiples of the volume of movable oil, introducing inefficiencies into the overall recovery process. High mobility ratios may accordingly be deleterious to the efficiency of conventional water flooding techniques.

In situ heavy oil recovery may also be assisted by thermal recovery techniques, such as injecting a heated fluid, typically steam, into the reservoir from an injection well. One process of this kind is steam-assisted gravity drainage (SAGD), involving a horizontal well pair to facilitate steam injection and oil production. As described in Canadian Patent No. 1,130,201, in SAGD the density of heavy oil, when heated to a temperature sufficient to mobilize the oil, is greater than the density of the hot aqueous condensate formed from the injected steam, so that the mobilized oil collects at the bottom of the steam chamber by gravity drainage.

The SAGD process is in widespread use to recover heavy hydrocarbons from the Lower Cretaceous McMurray Formation, within the Athabasca Oil Sands of northeastern Alberta, Canada. The geology of this region is emblematic of the geological complexities associated with many heavy oil bearing formations. In general terms, a thick sequence of marine shales and siltstones of the Clearwater Formation unconformably overlies the McMurray Formation in most areas of northeastern Alberta. In some areas, glauconitic sandstones of the Wabiskaw member are present at the base of the Clearwater. The Grand Rapids Formation overlies the Clearwater Formation, and quaternary deposits unconformably overlie the Cretaceous section. The pattern of hydrocarbon deposits within this geological context is complex and varied, and includes zones disposed towards the top or bottom of heavy oil deposits that have distinct fluid mobility characteristics. These zones include, for example, aquifers (top water zones, bottom water zones, or any geologic unit that can store and transmit water with relatively high permeabilities), gas caps (including top gas zones that have been produced, and therefore have reduced pressure), neighbouring chambers depleted of oil, and lower permeability facies that present significant vertical and/or horizontal fluid flow barriers. Collectively these zones may be called "lean" or "thief" zones, reflecting the effect of these zones on hydrocarbon recovery processes that use an injected fluid to improve mobility of the oil.

In general terms, thief zones are typically laterally continuous stratigraphic units of relatively high fluid mobility. In some cases, these zones may be characterized by distinct stratigraphic properties of permeability, for example being characterized by regions of relatively large pore radius. More generally, the relatively high fluid mobility within a thief zone is the result of the fluid characteristics of the zone, for example where the zone comprises a fluid, such as an aqueous fluid, having a relatively low viscosity. In practical terms, these are zones amenable to accommodating large volumes of an injected fluid. This characteristic is not necessarily associated with high values of absolute permeability (the measure of the capacity of a porous medium to transmit fluids of a fixed viscosity). For example, the absolute permeability contrast between a thief zone and a surrounding reservoir may be negligible, where the thief zone comprises a fluid having a much lower viscosity than the surrounding reservoir. In some circumstances, in contrast, there may be contrasts in permeability that characterize a thief zone, for example thief zones having greater permeability than surrounding reservoir zones by a factor of on the order of 20-500 times (Feng et al. 2010, J Petrol Sci Eng 75:13-18; Luo et al. 1999, Petrol Geology Oilfield Development in Daqing 18(5):39-41). A thief zone may accordingly be defined as a mobile zone adjacent to a less mobile zone, or a zone that has higher than average fluid mobility, transmissibility or flow capacity compared to another zone in the reservoir. In some cases, particularly in heavy oil and bitumen reservoirs, this may be the result of relatively high levels of water saturation in a thief zone, compared to surrounding zones having higher levels of heavy oil or bitumen saturation. In many cases, more than one such secondary zone may be present in a reservoir.

There is general recognition that thief zones of various kinds may pose particular challenges to heavy oil recovery operations (see Law et al., Journal of Canadian Petroleum Technology, 42, 10.2118/03-08-01; and, Li et al. 2016, Petrol Explor Prod Technol 6: 63). A variety of approaches may be used to facilitate heavy oil recovery processes in the presence of thief zones. For example, Canadian Patent Application No. 3,008,545 describes processes that involve the production of hydrocarbons using a buoyant solvent, from a reservoir compartment that has been sealed from a thief zone with an artificial composite seal made up of an injected blocking agent cooperating with an adjacent bitumen layer. Blocking agents such as foams have been described, for example in U.S. Pat. Nos. 4,495,995 and 4,706,752; and in Canadian Patent Application Nos 2,830,741 and 2,729,430. In an alternative approach, Canadian Patent Application No. 2,761,321 describes methods for selectively displacing water from a hydraulically continuous water zone, such as a top water zone.

SUMMARY OF THE INVENTION

Methods are provided that facilitate the production of hydrocarbons from subterranean formations, involving the mobilization of an immobile heavy oil in situ by gravity displacement. In effect, the heavy oil is mobilized by dense aqueous gravity displacement (DAGD), in a process that involves injecting an aqueous injection fluid into the formation through an injection well into an injection zone that is in fluid communication with the immobile heavy oil. The aqueous injection fluid has, during at least a portion of the recovery process, a density greater than the density of the immobile heavy oil (e.g. under native reservoir conditions), and a temperature greater than the temperature of the immobile heavy oil (e.g. under native reservoir conditions). An injection well is then operated so that the injection fluid mobilizes and displaces a displaced fraction of the immobile heavy oil, to provide an upwardly mobile heavy oil that rises by gravity displacement above a descending fraction of the aqueous injection fluid. In this way, an expanding upper zone of mobilized heavy oil is created in the formation above the injection zone.

The mobilized heavy oil may then be produced from the upper zone of mobile heavy oil, for example in a production fluid produced through a production well. In select embodiments, a flow control device may for example be operated in the production well so as to preferentially produce a hydrocarbon phase in the production fluid, and this may be facilitated by the difference in density or viscosity between the hydrocarbon phase and aqueous phase of fluids entering the production well. Flow control devices are for example described in U.S. Pat. Nos. 7,409,999; 6,112,817; 6,112,815; 5,803,179; and 5,435,393.

An aqueous fraction of the production fluid may be separated from an oil fraction of the production fluid, and a portion of the aqueous fraction of the production fluid may be recirculated and injected through the injection well. The nature of the DAGD process affords efficiencies in surface fluid treatment facilities. For example, a wellpad may be equipped with an injection wellhead for the injection well, a production wellhead for the production well, and a production fluid separator for separating the aqueous fraction of the production fluid from the oil fraction of the production fluid. In alternative embodiments, the injection and production wellheads may be entirely separate, or may be cooperating structures, for example where in a single well injection is carried out through a well tubing and production is carried out through an associated well casing. The wellpad may for example include one or more of: a fluid separation unit, a flotation unit, a filtration unit, and/or a hydrocyclone A wide variety of reservoirs may be amendable to DAGD recovery techniques, such as heavy oils within a bituminous oil sand reservoir, for example the McMurray formation in Alberta, Canada.

To facilitate ongoing gravity displacement, the density of the aqueous injection fluid may for example be increased over time. The injection fluid may be heated prior to injection, for example at the wellhead. Heaters used for heating may be, for example, an electric heater, an induction heater, an infrared heater, a radio-frequency heater, a microwave heater, a natural gas heater, a circulating fluid heater, or a combination thereof. The injection fluid may include blowdown water from steam generation, so that the injection fluid is heated at least in part as a byproduct of a process for steam generation. In some embodiments, the injection fluid may include produced formation water, such as water recovered from an aquifer that is below injection zone, which may for example have a temperature greater than the temperature of the immobile heavy oil in situ. The injection fluid may also, from time to time, include steam and/or solvents or other additives. When steam is injected, or co-injected, the density of the injection fluid may, for a time, be lower than the density of the bitumen. Over time, the process may accordingly be managed so that fluids of varying density are injected, while managing over time the density-based displacement of mobilized bitumen.

DAGD techniques may usefully be applied in reservoirs that include one or more thief zones. These thief zones may for example be characterized as laterally continuous stratigraphic units of relatively high fluid mobility, transmissibility or flow capacity, for example having fluid mobility, transmissibility or flow capacity equal to or greater than 2, 5, 10 or 20 times the average fluid mobility, transmissibility or flow capacity of an adjoining heavy-oil-bearing reservoir zone. The thief zone may for example be an aquifer, such as a top or bottom water zone, or a gas zone. Thief zones may also be characterized by relatively high porosity, such as an average porosity of at least 0.2, and/or permeability (e.g. greater than or equal to 1,000 mD), although these absolute characteristics may be shared by adjoining pay zones of the reservoir. In some embodiments, a blocking fluid may be injected to constrain fluid flow, including injected fluid flow, into a thief zone.

The aqueous injection fluid may for example include fluids produced from an aquifer, such as a deep saline aquifer. Such aquifers may for example be located below the injection zone, and may also conveniently provide for carbon dioxide sequestration.

In DAGD, in direct contrast to conventional water flooding, the viscosity of the upwardly mobilized heavy oil will generally be greater than the viscosity of the descending fraction of the injection fluid, so that the mobility ratio there between is greater than 1. This characteristic may for example be achieved where the immobile heavy oil has a mass density of greater than about 900 kg/m3.

In select embodiments, the relatively high density of the produced water phase will be utilized to facilitate oil and water separation at the surface. This may for example take place at or near a wellpad, obviating the need to transport production fluids to a central processing facility. The near-wellpad recovery of produced water may also serve the purpose of facilitating the retention of heat in the produced water, which may accordingly be reinjected with little or no addition of thermal energy. Surface separation equipment may for example include gravity separators (including upside-down separators), flotation units (such as an induced gas or induced static flotation unit, or compact flotation unit, see *Advances in Compact Flotation Units* (*CFUs*) *for Produced Water Treatment* by Bhatnagar, M. & Sverdrup, C. J. Offshore Technology Conference Asia held in Kuala Lumpur, Malaysia, 25-28 Mar. 2014 (OTC-24679-MS)), filtration units (see for example oil removal filtration processes as described in U.S. Pat. Nos. 6,180,010, 5,437,793, 5,698,139, 5,837,146, 5,961,823 and 7,264,722), and/or hydrocyclones (cyclones are for example described in the following patent documents: U.S. Pat. Nos. 5,017,288; 5,071,557; and 5,667,686). Chemicals may optionally be added to aid steps of fluid separation.

Injection wells may for example be horizontal or vertical, in a wide variety of configurations and completions. In some embodiments, the depth of dense aqueous fluid injection may be adjusted over time, for example maintaining the injection zone proximal to the top of the immobile bitumen zone, lowering the point of injection as mobilized bitumen floats away from the top of the immobile bitumen zone.

In some embodiments, injection wells may be repurposed as production wells, and vice versa. A vertical injection well may for example be completed and operated so that it may alternatively function as a dense aqueous fluid injection well and a mobilized heavy oil production well, for example varying the elevation of the position in the well that is in fluid communication with the reservoir.

Aqueous injection fluids may for example include additives, such as a solvent, polymer, surfactant or densifier. The additive may for example be used to increase the mobility of the upwardly mobile heavy oil, for example by one or more of: modifying an emulsion characteristic of the upwardly mobile heavy oil (i.e., reduction in emulsion viscosity); reducing interfacial tension of the upwardly mobile heavy oil (thereby improving relative permeability of the formation to the upwardly mobile heavy oil); reducing upwardly mobile heavy oil viscosity (for example due to dissolved solvent in the upwardly mobile heavy oil); reducing upwardly mobile heavy oil density (for example due to dissolved solvent in the upwardly mobile heavy oil); precipitating asphaltenes in the upwardly mobile heavy oil (which may result in a mobile oil that is in effect upgraded, and may have a resulting lowered viscosity and density).

DETAILED DESCRIPTION OF THE INVENTION

Figure 1:
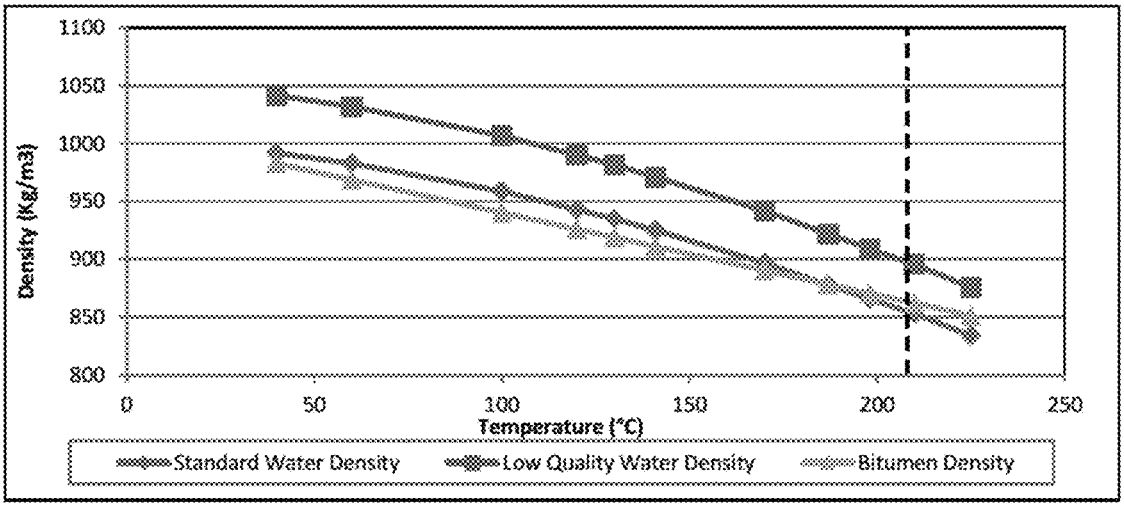
FIG. 1 is a line graph, showing fluid density vs temperature for bitumen, "standard" water (of low salinity) and "low quality" (1% salinity) water.

In the context of the present application, various terms are used in accordance with what is understood to be the ordinary meaning of those terms. For example, "petroleum" is a naturally occurring mixture consisting predominantly of hydrocarbons in the gaseous, liquid or solid phase. In the context of the present application, the words "petroleum" and "hydrocarbon" are used to refer to mixtures of widely varying composition. The production of petroleum from a reservoir necessarily involves the production of hydrocarbons, but is not limited to hydrocarbon production and may include, for example, trace quantities of metals (e.g. Fe, Ni, Cu, V). Similarly, processes that produce hydrocarbons from a well will generally also produce petroleum fluids that are not hydrocarbons. In accordance with this usage, a process for producing petroleum or hydrocarbons is not necessarily a process that produces exclusively petroleum or hydrocarbons, respectively. "Fluids", such as petroleum fluids, include both liquids and gases. Natural gas is the portion of petroleum that exists either in the gaseous phase or in solution in crude oil in natural underground reservoirs, and which is gaseous at atmospheric conditions of pressure and temperature. Natural gas may include amounts of non-hydrocarbons. The abbreviation POIP stands for "producible oil in place" and in the context of the methods disclosed herein is generally defined as the exploitable or producible oil structurally located above the production well elevation.

It is common practice to segregate petroleum substances of high viscosity and density into two categories, "heavy oil" and "bitumen". For example, some sources define "heavy oil" as a petroleum that has a mass density of greater than about 900 kg/m$^3$. Bitumen is sometimes described as that portion of petroleum that exists in the semi-solid or solid phase in natural deposits under native reservoir conditions, with a mass density greater than about 1,000 kg/m$^3$ and a viscosity greater than 10,000 centipoise (cP; or 10 Pa.s) measured at original temperature in the deposit and atmospheric pressure, on a gas-free basis. Under reservoir conditions associated with recovery operations, for example when reservoir temperatures are elevated above native reservoir conditions, the density and viscosity of heavy oil and bitumen may fall significantly below these values. Although these terms are in common use, references to heavy oil and bitumen represent categories of convenience and there is a continuum of properties between heavy oil and bitumen. Accordingly, references to heavy oil and/or bitumen herein include the continuum of such substances, and do not imply the existence of some fixed and universally recognized boundary between the two substances. In particular, the term "heavy oil" includes within its scope all "bitumen" including hydrocarbons that are present in semi-solid or solid form.

A "reservoir" is a subsurface formation containing one or more natural accumulations of moveable petroleum, which are generally confined by relatively impermeable rock. An "oil sand" or "oil sands" reservoir is generally comprised of strata of sand or sandstone containing petroleum. A "zone" in a reservoir is an arbitrarily defined volume of the reservoir, typically characterised by some distinctive property. Zones may exist in a reservoir within or across strata or facies, and may extend into adjoining strata or facies. In some cases, reservoirs containing zones having a preponderance of heavy oil are associated with zones containing a preponderance of natural gas. This "associated gas" is gas that is in pressure communication with the heavy oil within the reservoir, either directly or indirectly, for example through a connecting water zone. A pay zone is a reservoir volume having hydrocarbons that can be recovered economically.

"Thermal recovery" or "thermal stimulation" refers to enhanced oil recovery techniques that involve delivering thermal energy to a petroleum resource, for example to a heavy oil reservoir. There are a significant number of thermal recovery techniques other than SAGD, such as cyclic steam stimulation (CSS), in-situ combustion, hot water flooding, steam flooding and electrical heating. In general, thermal energy is provided to reduce the viscosity of the petroleum to facilitate production.

A "chamber" within a reservoir or formation is a region that is in fluid/pressure communication with a particular well or wells, such as an injection or production well. For example, in a SAGD process, a steam chamber is the region of the reservoir in fluid communication with a steam injection well, which is also the region that is subject to depletion, primarily by gravity drainage, into a production well.

"Reservoir compartmentalization" is a term used to describe the segregation of a petroleum accumulation into a number of distinct fluid/pressure compartments. In general, this segregation takes place when fluid flow is prevented across sealed boundaries in the reservoir. These boundaries may for example be caused by a variety of geological and fluid dynamic factors, involving: static seals that are completely sealed and capable of withholding (trapping) petroleum deposits, or other fluids, over geological time; and dynamic seals that are low to very low permeability flow barriers that significantly reduce fluid cross-flow to rates that are sufficiently slow to cause the segregated chambers to have independent fluid pressure dynamics, although fluids and pressures may equilibrate across a dynamic seal over geological time-scales (Reservoir compartmentalization: an introduction, Jolley et al., Geological Society, London, Special Publications 2010, v. 347, p. 1-8). A reservoir compartment may be hydraulically confined, so that fluids are prevented from moving beyond the compartment by sealed boundaries confining the compartment.

A hydrocarbon reservoir may for example have a heavy oil compartment hydraulically separated from a secondary zone by an artificial permeability barrier, for example made up of a functional composite seal provided by an injected blocking agent, so that under oil recovery conditions the flow of an injected fluid across the permeability barrier is restricted.

Secondary zones of potential concern may for example include top water zones, which give rise to the potential for fluid communication between the secondary zone and the underlying bitumen zone as a consequence of a recovery operation. During recovery operations, a buoyant mobilized heavy oil, being less dense than the dense injection fluids, will rise in the recovery chamber and may have a tendency to spread laterally. In this circumstance, it may be desirable to hydraulically isolate a top mobilized oil recovery zone from the surrounding secondary zone. Hydraulic isolation may for example involve creating an artificially segregated zone by injecting blocking agents to confine the artificially segregated zone. For example, a segregated zone of top or bottom water may be defined by a circumferential fence comprised of injected blocking agent. In this way, a secondary zone of potential concern, such as a thief zone, may be effectively sealed to prevent the migration of mobilized hydrocarbons away from the recovery zone.

Blocking agents may for example include resins, namely epoxy resins, phenolic resins, or furans. Epoxy resins are almost exclusively thermoset. Phenolic resins have been used extensively in steam flooding applications and are generally not, or moderately, sensitive to water. Phenolic resins are generally activated in the reservoir by an acidic or basic chemical activating agent. Furans may be chemically set with an acid. Certain phenolic resins and furans may set without secondary zone pre-heating. An alternative blocking agent may comprise an ultra-high melting point petroleum wax, or a wax based on another substance, and the wax may for example be heated to lower the viscosity of the wax and then injected into the reservoir to the desired location in the secondary zone. The wax may then "set-up" at the native temperature of the secondary zone.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing. Citation of references herein is not an admission that such references are prior art to the present invention. Any priority document(s) and all publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

EXAMPLE

Detailed computational simulations of reservoir behavior have been carried out to exemplify various aspects of the processes disclosed herein, illustrating that dense aqueous fluids may be injected so as to heat, mobilize and displace a relatively less-dense heavy oil in situ.

The reservoir characteristics of the simulated 2D reservoir are as follows, using a conventional homogenous simulation comprised of a 10 m thick water zone ($S_w$=80% and $S_o$=20%) overlaying 20 m thick reservoir ($S_w$=20% and $S_o$=80%). Grids for reservoir and transition zone (top water zone) were defined as follows:

Reservoir grid 500m x 1m x 20m;

X: 500×2 m;

Y: 1×800 m ;

Z: 20×1 m.

Simulation properties of the reservoir are set out in Table 1.

TABLE 1

Simulation Properties of Reservoir

| Property | Value | Units |
|---|---|---|
| Solid | sand | N/A |
| Initial Reservoir | 12 | C. |

TABLE 1-continued

| Simulation Properties of Reservoir | | |
|---|---|---|
| Property | Value | Units |
| Temperature | | |
| Initial Reservoir Pressure | 1300 | kPa |
| Initial Water Saturation | 0.2 | N/A |
| Initial Oil Saturation | 0.8 | N/A |
| Initial methane fraction in oil | 0 | Mol % |
| $K_H$ | 9.5 | D |
| $K_V$ | 7.9 | D |
| Porosity | 0.34 | N/A |

In the simulation, the transition zone (top water zone) was defined as follows:

Transition_zone grid 510 x 1 x 10;

X: 64 m 32 m 16 m 4 m 2m 500×2 m 2 m 4 m 16 m 32 m 64 m;

Y: 1×800 m;

Z: 10×1 m.

Simulation properties of the transition zone are set out in Table 2.

TABLE 2

| Simulation Properties for Transition Zone | | |
|---|---|---|
| Property | Value | Units |
| Solid | sand | N/A |
| Initial Reservoir Temperature | 12 | C. |
| Initial Reservoir Pressure | 1100 | kPa |
| Initial Water Saturation | 0.8 | N/A |
| Initial Oil Saturation | 0.2 | N/A |
| Initial methane fraction in oil | 0 | Mol % |
| $K_H$ | 9.5 | D |
| $K_V$ | 7.9 | D |
| Porosity | 0.34 | N/A |

Figure 2:
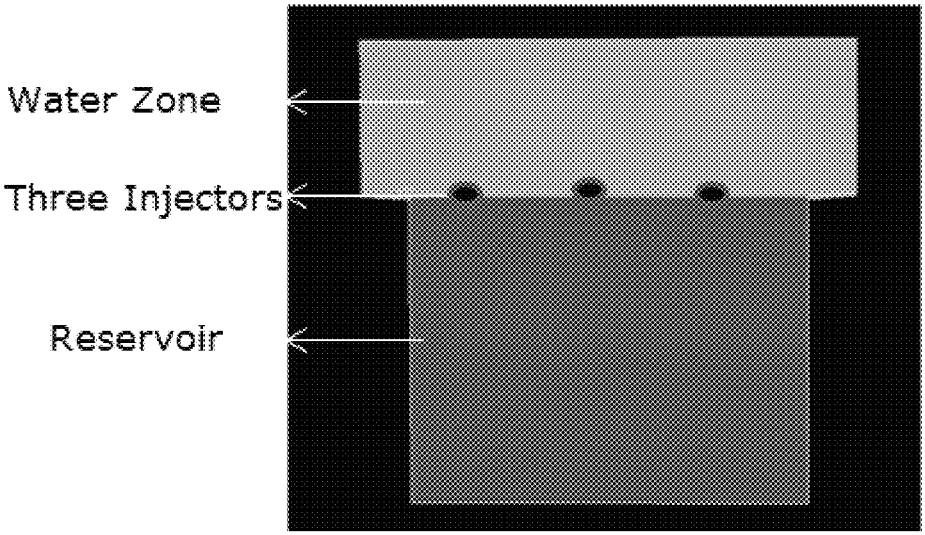
FIG. 2 is a schematic illustration of a reservoir simulation set up, showing a top water zone, three injection wells and an underlying heavy oil reservoir.
Figure 3:
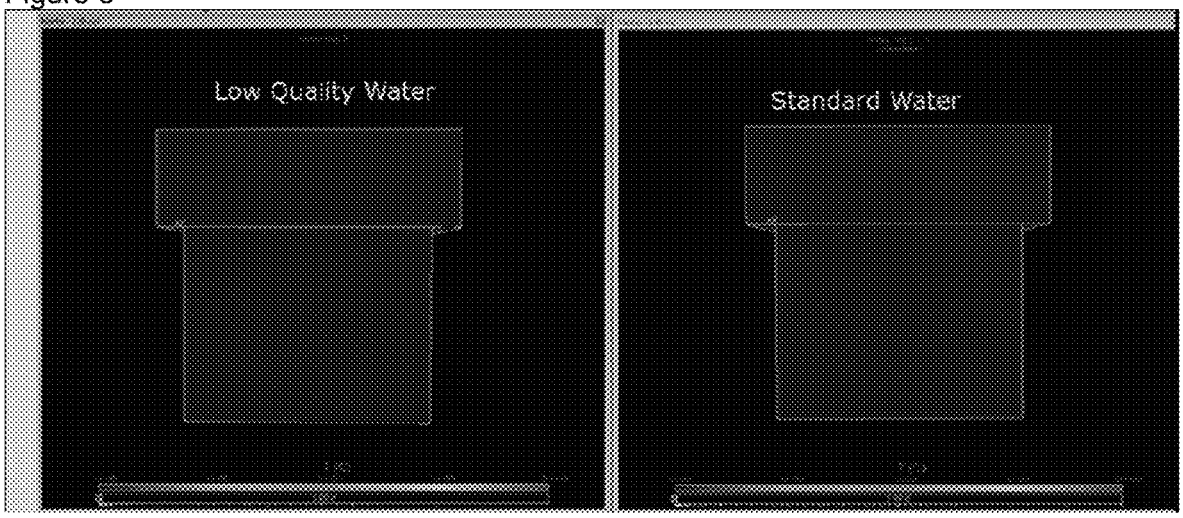
FIG. 3 is a schematic illustration of simulated reservoir conditions, showing temperature profile at time =0 years.
Figure 4:
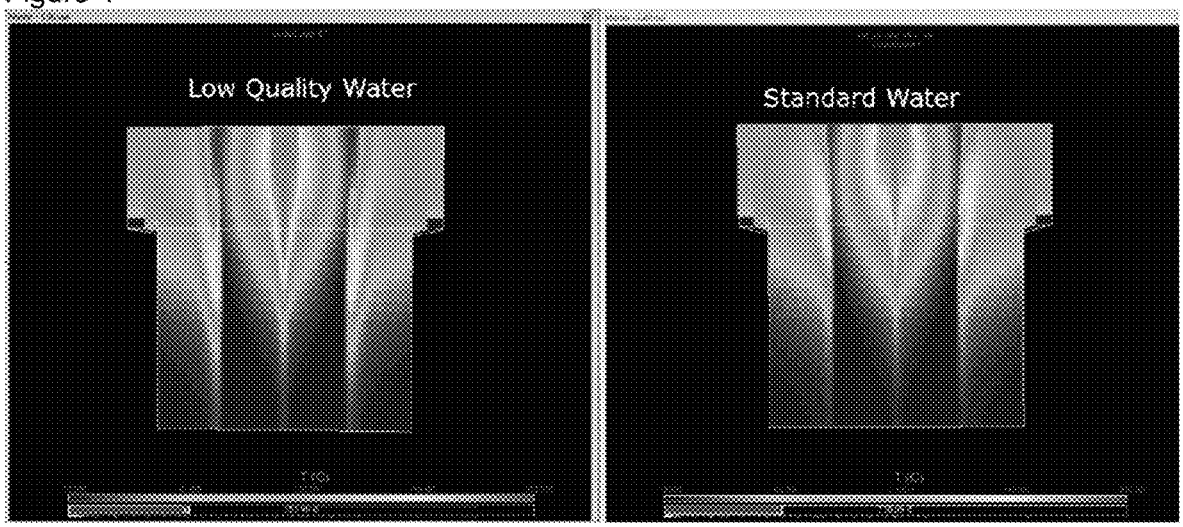
FIG. 4 is a schematic illustration of simulated reservoir conditions, showing temperature profile at time =2 years.
Figure 5:
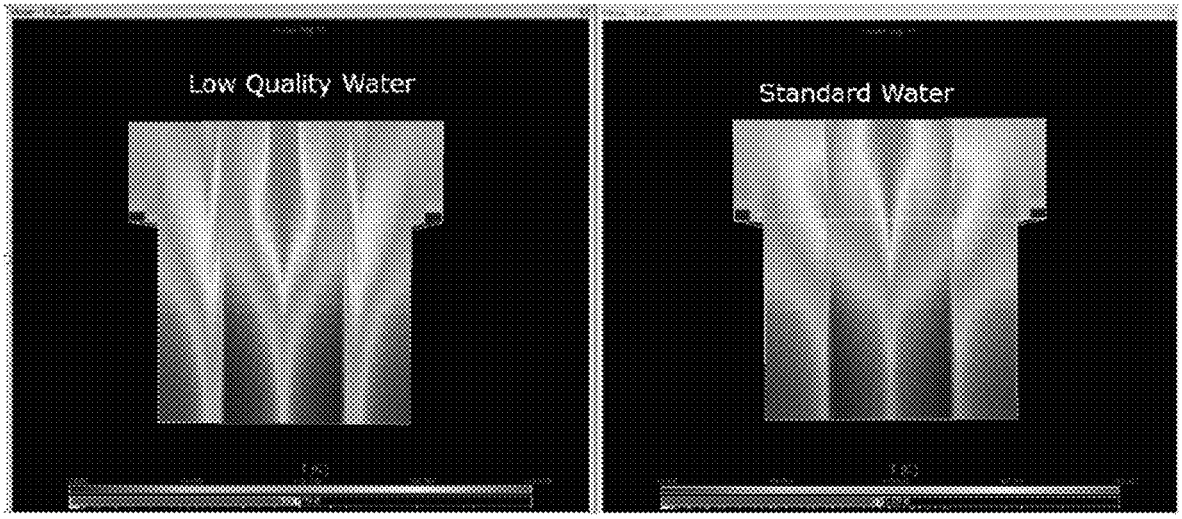
FIG. 5 is a schematic illustration of simulated reservoir conditions, showing temperature profile at time =4 years.
Figure 6:
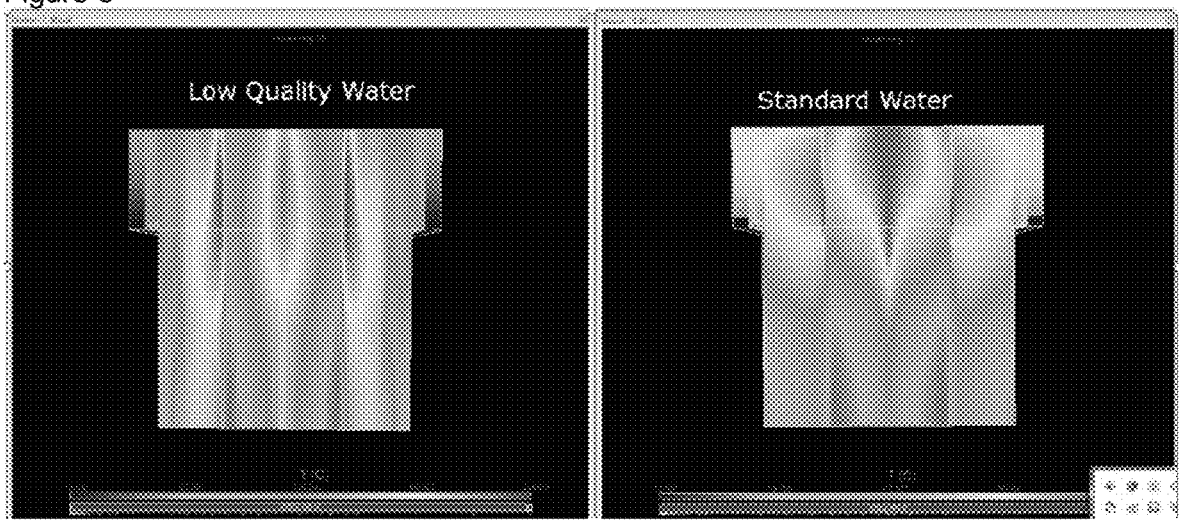
FIG. 6 is a schematic illustration of simulated reservoir conditions, showing temperature profile at time =8 years.
Figure 7:
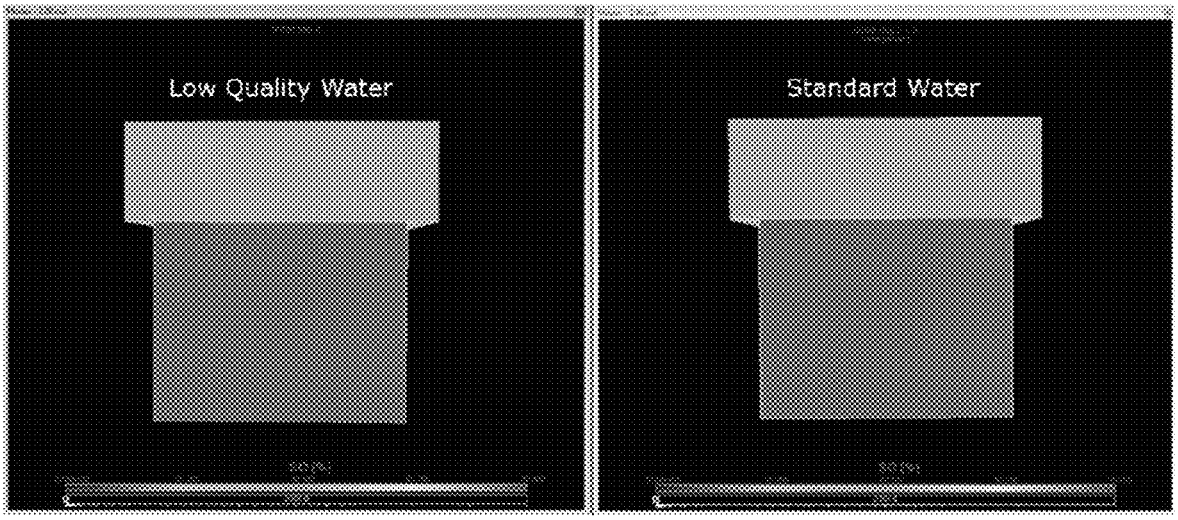
FIG. 7 is a schematic illustration of simulated reservoir conditions, showing oil saturation profile at time =0 years.
Figure 8:
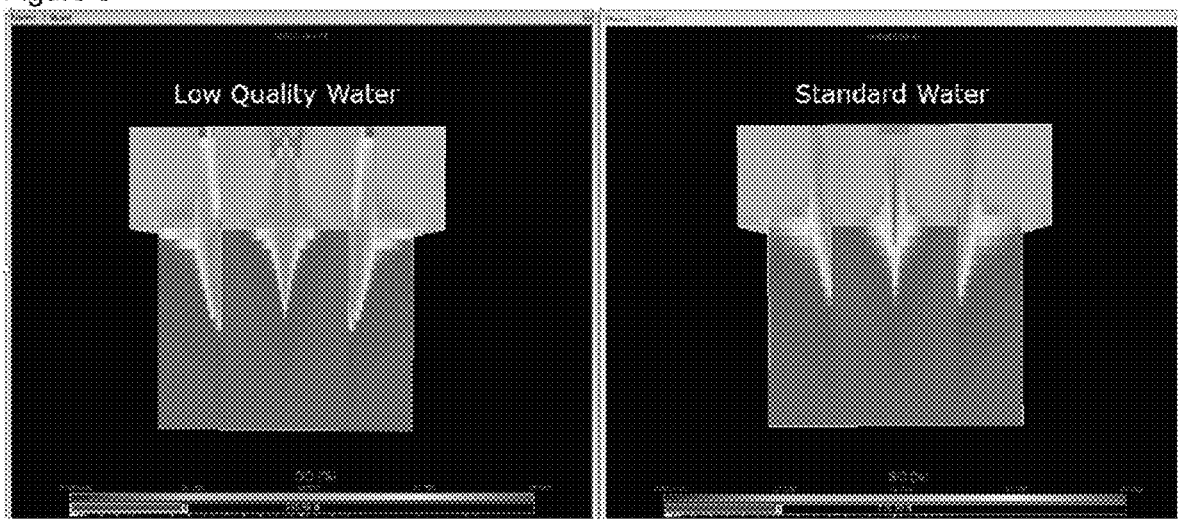
FIG. 8 is a schematic illustration of simulated reservoir conditions, showing oil saturation profile at time =2 years.
Figure 9:
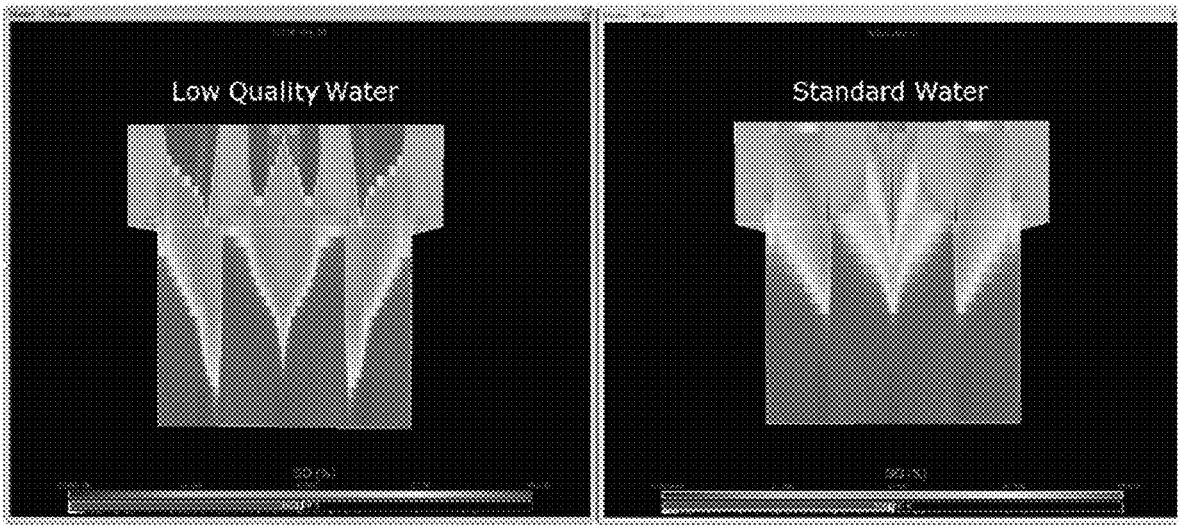
FIG. 9 is a schematic illustration of simulated reservoir conditions, showing oil saturation profile at time =4 years.
Figure 10:
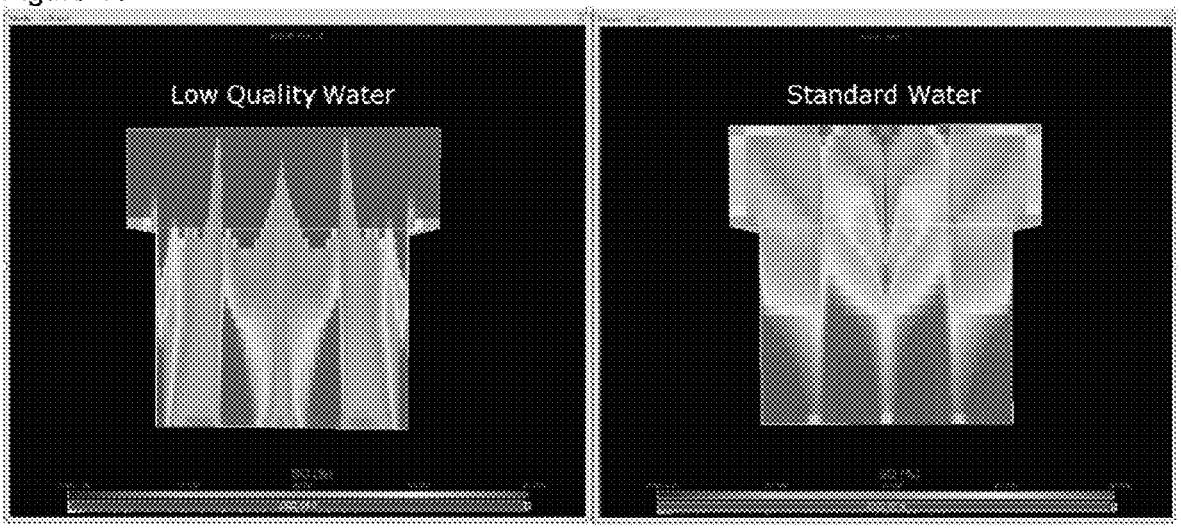
FIG. 10 is a schematic illustration of simulated reservoir conditions, showing oil saturation profile at time =8 years.

Two edge blocks within the simulation have infinite porosity (1e6) to mimic a flowing aquifer and maintain 1100 KPa at all times. Three hot water injectors were placed at the bottom of the Transition Zone, simulating hot aqueous fluid injection that is in fluid communication with the heavy oil, and accordingly facilitating heat transfer to the heavy oil reservoir. The three injectors are located equidistant to each other. Hot (211° C.) low quality (1% saline) water was injected at a pressure of 2000 KPa and a rate of 3500 $Sm^3/d$ per well. The total of three wells injected 10500 $Sm^3/d$. The simulation grid set up is shown schematically in FIG. 2, with shading illustrating relative oil saturation, 20% in the water zone (Transition Zone) and 80% in the reservoir.

FIGS. 3 to 6 illustrate the evolution of the heat transfer profile for simulated injection of low quality (dense 1% saline) water compared to injection of standard (no salinity) water, over a period from 0 to 8 years. As illustrated, heated water injection at 211° C. and 2000 KPa can be seen to heat the reservoir, with distinct differences in the temperature profile over time when a dense aqueous fluids (low quality water) is used compared to standard water.

FIGS. 7 to 10 illustrate the evolution of the oil saturation profile for simulated injection of low quality (dense 1% saline) water compared to injection of standard (no salinity) water, over a period from 0 to 8 years. As illustrated, heated bitumen is mobilized and, being lighter than the saline injection fluid, migrates upwardly by gravity displacement towards the transition zone, so that a portion of the mobilized heavy oil arrives in the transition zone so as to overlie the injection zone. This gravity dominated fluid inversion process, dense aqueous gravity displacement (DAGD), does not take place when the aqueous injection fluid is not saline (standard water).

Figure 11:
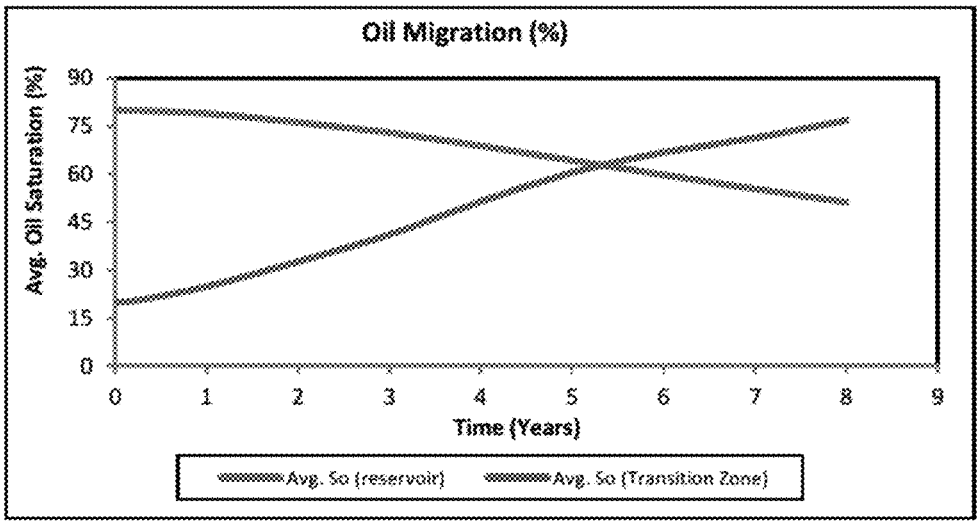
FIG. 11 is a line graph showing a change in simulated oil saturation over time, with the average oil saturation ($S_o$) in the reservoir decreasing over time and the average $S_o$ of the transition zone increasing over time, providing an oil migration profile over time.
Figure 12:
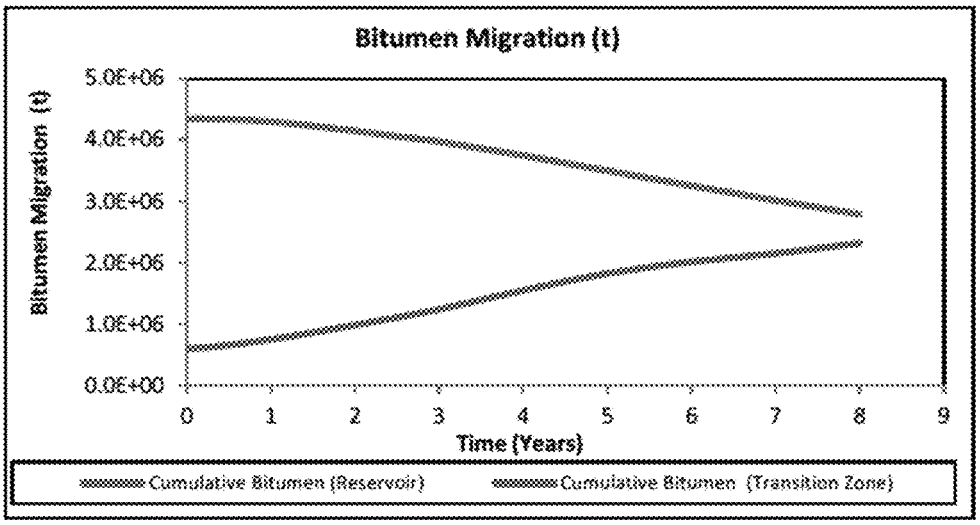
FIG. 12 is a line graph illustrating a change in simulated oil (bitumen) migration volumes over time, showing a decrease in cumulative reservoir bitumen over time and an increase in cumulative transition zone bitumen over time, providing a profile of simulated oil volume migration between the reservoir and transition zone over time.

Consistent with the DAGD process, FIG. 11 shows the change in simulated oil saturation over time, with the average oil saturation ($S_o$) in the reservoir decreasing over time and the average $S_o$ of the transition zone increasing over time, providing an oil migration profile over time that is ultimately favourable to production of the mobilized bitumen from the transition zone. Similarly, FIG. 12 illustrates the change in simulated oil (bitumen) migration volumes over time, showing a decrease in cumulative reservoir bitumen over time and a corresponding increase in cumulative transition zone bitumen over time, providing a profile of simulated oil volume migration from the reservoir to the transition zone over time. In terms of volume, 36% of oil in place migrates over the simulation time period from the reservoir to the transition zone.

An equivalent steam to oil ratio may be calculated for the reservoir and the transition Zone, using the following equation (in which, M=mass in Kg; and H=enthalpy in J/Kg or KJ/Kg):

$$\text{Equivalent } CSOR = \frac{(m_{steam} * H_{steam} + m_{solvent} * H_{solvent})}{(m_{oil} * H_{steam,ref})}$$

Figure 13:
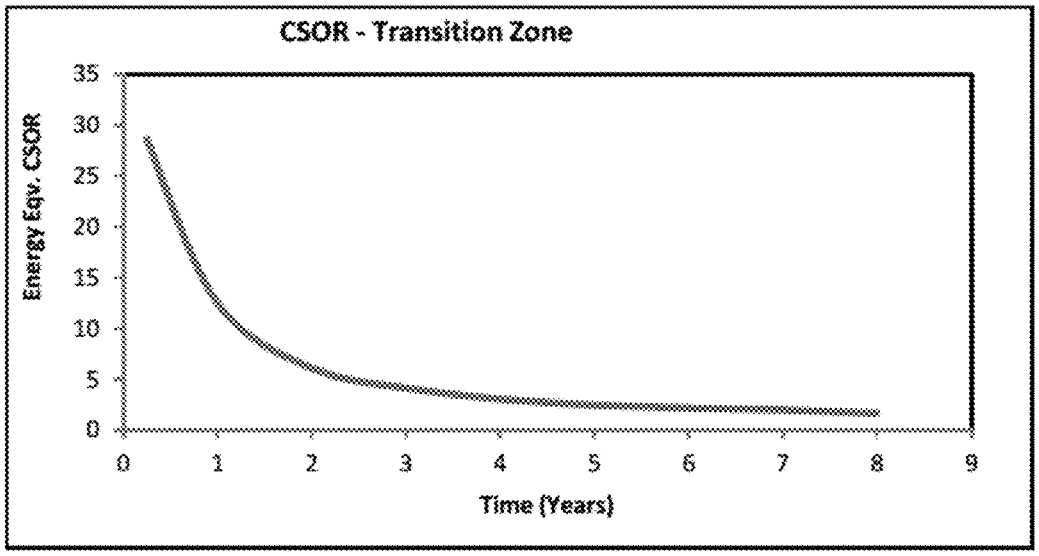
FIG. 13 is a line graph showing the change in cumulative stream oil ratio (CSOR) over time for the simulated transition zone.
Figure 14:
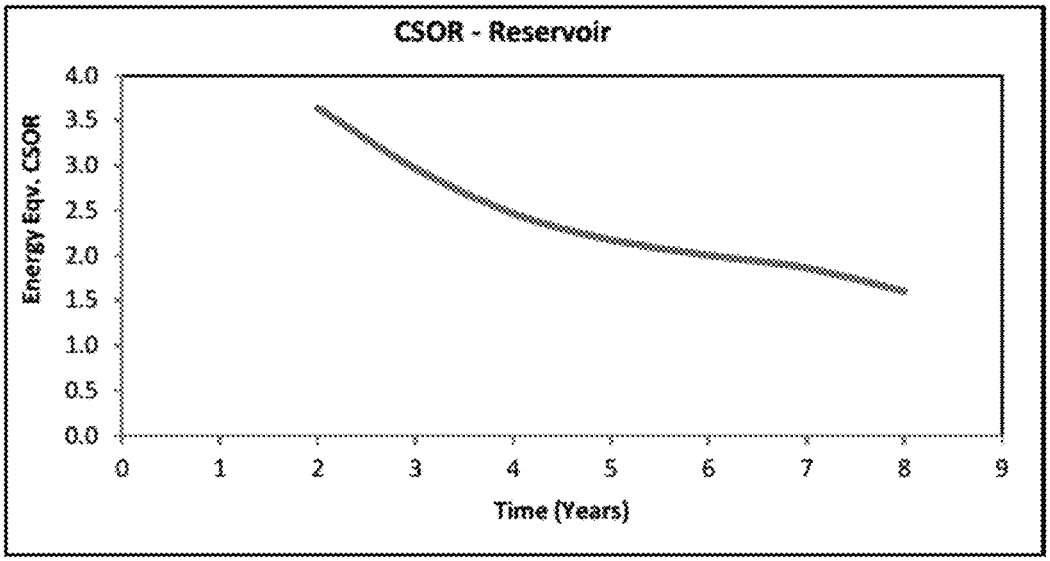
FIG. 14 is a line graph showing the change in CSOR over time for the simulated reservoir.

FIG. 13 illustrates the change in cumulative stream oil ratio (CSOR) over time for the simulated transition zone. FIG. 14 illustrates the corresponding change in CSOR over time for the simulated reservoir. CSOR is calculated assuming 60% oil in place at a given time can be recovered.

Figure 15:
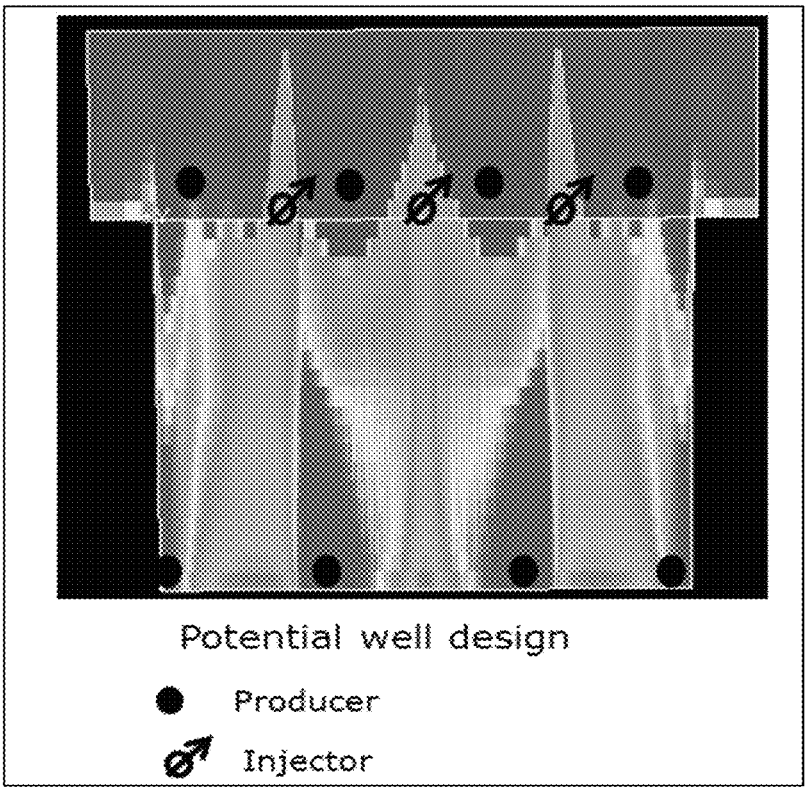
FIG. 15 is s schematic illustration of one prospective well configuration for production and injection wells in a reservoir in which heavy oil has been mobilized by dense aqueous gravity displacement (DAGD).
Figure 16:
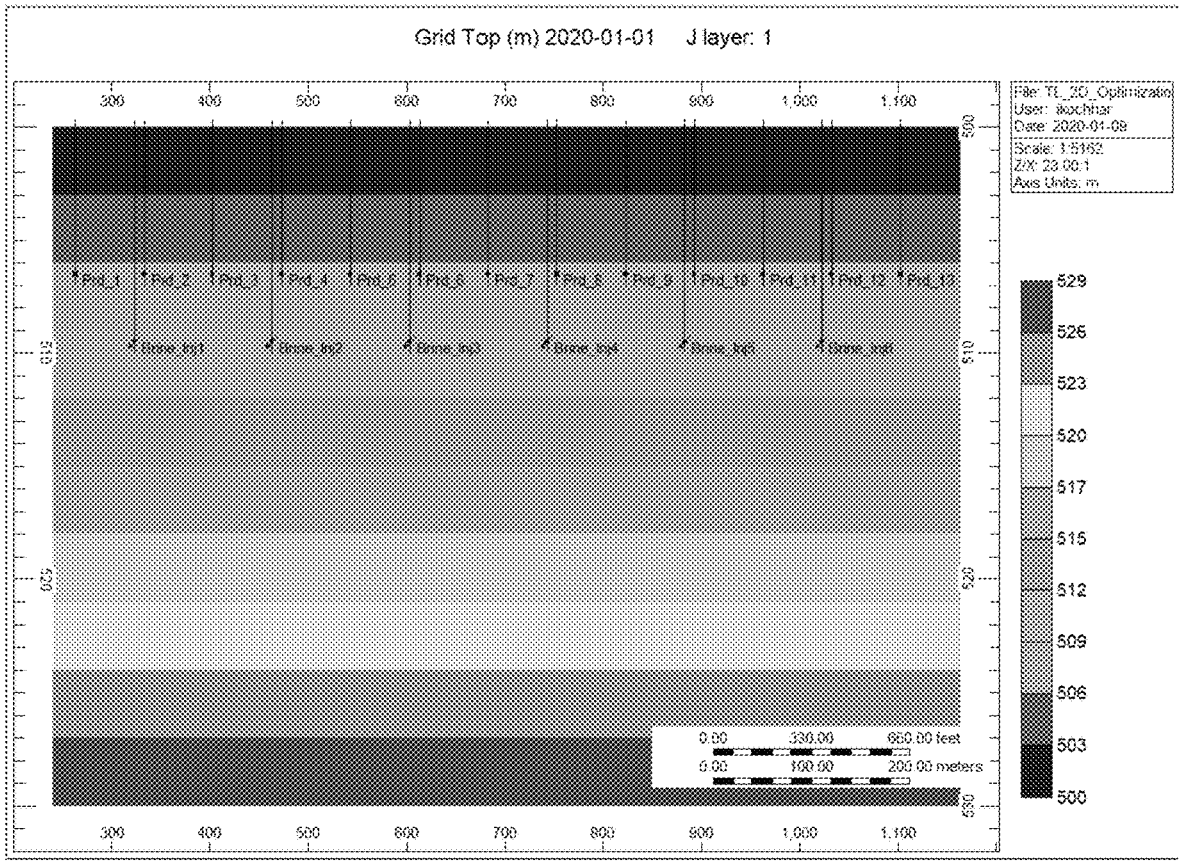
FIG. 16 is a schematic illustration of a modeled well configuration for 13 production and 6 injection wells in a reservoir in which heavy oil is to be mobilized by dense aqueous gravity displacement (DAGD).

This example illustrates the efficacy of a heavy oil mobilization and recovery scheme that makes use of hot dense fluid injection. Techniques of this kind may for example be implemented in oil sands deposits, for example in deposits that are characterized by overlying mobile transition zones (e.g. water and/or gas caps). FIG. 15 is s schematic illustration of one prospective well configuration for production and injection wells in a reservoir in which heavy oil has been mobilized by dense aqueous gravity displacement (DAGD). A very wide variety of well configurations are possible in alternative embodiments. FIG. 16 illustrates one modeled implementation, in which there are 6 injection wells at the base of a thief zone of mobile top water, and 13 production wells located approximately 3 m above the injectors. The positioning of the injection and production wells will accordingly vary widely based on the geology of the reservoir and the operating parameters of the recovery operation.

The invention claimed is:

1. A method for mobilizing an immobile heavy oil in situ within a reservoir by gravity displacement in a subterranean formation, comprising:

injecting an aqueous injection fluid into the formation through an injection well into an injection zone that is in fluid communication with the immobile heavy oil, the aqueous injection fluid having a density greater than the density of the immobile heavy oil and a temperature greater than the temperature of the immobile heavy oil, wherein the aqueous injection fluid comprises a produced formation water recovered from an aquifer that is below the injection zone, wherein the produced formation water has a temperature greater than the temperature of the immobile heavy oil in situ; and, operating the injection well so that the injection fluid mobilizes and displaces a displaced fraction of the immobile heavy oil, to provide an upwardly mobile heavy oil that rises by gravity displacement above a descending fraction of the aqueous injection fluid, such that an expanding upper zone of mobilized heavy oil is created in the formation above the injection zone.

2. The method of claim 1, further comprising producing the mobilized heavy oil from the upper zone of mobile heavy oil in a production fluid produced through a production well.

3. The method of claim 2, wherein producing the mobilized heavy oil comprises operating a flow control device so as to preferentially produce a hydrocarbon phase in the production fluid.

4. The method of claim 2, further comprising separating an aqueous fraction of the production fluid from an oil fraction of the production fluid, and further comprising recirculating and injecting at least a portion of the aqueous fraction of the production fluid through the injection well.

5. The method of claim 2, wherein:

the injection well comprises a substantially horizontal injection well segment and the aqueous injection fluid is injected into the formation through the substantially horizontal injection well segment; and, the production well comprises a substantially horizontal production well segment, and the mobilized heavy oil is collected for production through the substantially horizontal production well segment.

6. The method of claim 5, wherein the substantially horizontal production well segment is vertically offset above the substantially horizontal injection well segment.

7. The method of claim 1, wherein the immobile heavy oil reservoir is a bituminous oil sand reservoir.

8. The method of claim 1, wherein the density of the aqueous injection fluid is increased over time.

9. The method of claim 1, wherein the aqueous injection fluid is heated prior to or following injection.

10. The method of claim 1, wherein the reservoir comprises a thief zone and the average fluid mobility, transmissibility or flow capacity of the thief zone is greater than the average fluid mobility, transmissibility or flow capacity of an adjoining heavy-oil-bearing reservoir zone.

11. The method of claim 1, wherein the viscosity of the upwardly mobilized heavy oil is greater than the viscosity of the descending fraction of the injection fluid, so that the mobility ratio there between is greater than 1.

12. The method of claim 1, wherein the immobile heavy oil has a mass density under native reservoir conditions of greater than about 900 kg/m$^3$.

13. The method of claim 1, further comprising injecting an additive into the formation with or in addition to the aqueous injection fluid, wherein the additive is a steam, solvent, polymer, surfactant or densifier, and wherein, the additive increases mobility of the upwardly mobile heavy oil.

14. The method of claim 1, wherein the aqueous injection fluid has a density greater than the density of the immobile heavy oil under native reservoir conditions and a temperature greater than the temperature of the immobile heavy oil under the native reservoir conditions.

15. A method for mobilizing an immobile heavy oil in situ within a bituminous oil sand reservoir by gravity displacement in a subterranean formation, wherein the immobile heavy oil has a mass density under native reservoir conditions of greater than about 900 kg/m$^3$, comprising:

injecting an aqueous injection fluid into the formation through an injection well into an injection zone that is in fluid communication with the immobile heavy oil, the aqueous injection fluid having a density greater than the density of the immobile heavy oil and a temperature greater than the temperature of the immobile heavy oil, wherein the aqueous injection fluid comprises a produced formation water recovered from an aquifer that is below the injection zone, wherein the produced formation water has a temperature greater than the temperature of the immobile heavy oil in situ; and, operating the injection well so that the injection fluid mobilizes and displaces a displaced fraction of the immobile heavy oil, to provide an upwardly mobile heavy oil that rises by gravity displacement above a descending fraction of the aqueous injection fluid, such that an expanding upper zone of mobilized heavy oil is created in the formation above the injection zone;

producing the mobilized heavy oil from the upper zone of mobile heavy oil in a production fluid produced through a production well; and, separating an aqueous fraction of the production fluid from an oil fraction of the production fluid, and recirculating and injecting at least a portion of the aqueous fraction of the production fluid through the injection well.

16. The method of claim 15, wherein the viscosity of the upwardly mobilized heavy oil is greater than the viscosity of the descending fraction of the injection fluid, so that the mobility ratio there between is greater than 1.

* * * * *